United States Patent [19]

Owens

[11] 4,335,513

[45] Jun. 22, 1982

[54] SAFETY BAR FOR USE WITH CHAIN SAW OR THE LIKE

[76] Inventor: James L. Owens, 4210 Stoneybrook Rd., Clemmons, N.C. 27012

[21] Appl. No.: 180,888

[22] Filed: Aug. 25, 1980

[51] Int. Cl.[3] ..... B27B 17/02

[52] U.S. Cl. ..... 30/382

[58] Field of Search ..... 30/382, 383, 384, 166 R, 30/370

[56] References Cited

U.S. PATENT DOCUMENTS

| | | | |
|---|---|---|---|
| 3,380,493 | 4/1968 | Giroux | 30/382 |
| 3,384,136 | 5/1968 | Marin | 30/382 |
| 4,060,894 | 12/1977 | Hampton | 30/382 |

FOREIGN PATENT DOCUMENTS

| | | | |
|---|---|---|---|
| 746304 | 11/1966 | Canada | 30/382 |

*Primary Examiner*—Jimmy C. Peters
*Attorney, Agent, or Firm*—Gerald J. Ferguson, Jr.; Joseph J. Baker

[57] ABSTRACT

In combination with a chain saw having a housing and an endless cutting chain supported by the housing, an elongated bar, apparatus for pivotally mounting the bar with respect to the housing so that, in a lowered position thereof, the bar extends in the plane of the cutting chain substantially parallel to the chain, apparatus for biasing the bar toward the lowered position, a stop member for maintaining a predetermined spacing between the bar in its lowered position and the cutting chain where the spacing is open to facilitate viewing of the cutting chain in operation and apparatus for pivoting the bar from its lowered position to a raised position to facilitate undercut operations.

9 Claims, 4 Drawing Figures

SAFETY BAR FOR USE WITH CHAIN SAW OR THE LIKE

BACKGROUND OF THE INVENTION

This invention relates to safety devices for chain saws and the like.

Extreme caution must be used in operating a chain saw. As the tip of the saw touches a log or hits a twig on the other side of it, the saw sometimes kicks back and may strike the operator. Further, one using a chain saw for a long period of time may become careless, further increasing the chance of a serious injury.

Safety guards have been developed to protect chain saw operators from the aforementioned dangers. Typical are those that project completely over the saw chain. The main drawbacks of these devices are that, not only do they add weight and bulk, they also impair free movement of the chain saw. A chain saw can cut on both the upstroke and the downstroke. Previous safety attachments, which hamper these unrestricted cutting movements or obstruct the operator's vision, reduce efficiency. To avoid these problems, many operators simply remove the safety attachments.

Much of the prior art has also caused storage problems due to the added bulk of these devices. An example is carrying cases used by some operators to transport the saws. When guards are mounted onto a saw, the entire assembly doesn't fit into the typical carrying case. Further, it has been difficult to temporarily remove the guards to place the saw in the carrying cases.

SUMMARY OF THE INVENTION

It is therefore a principal object of the invention to provide a lightweight guard that will protect chain saw users from kickbacks and other dangers, but will not impair efficiency by greatly increasing weight and bulk or obstructing visibility or interfering with the action of undercutting.

It is a further object to provide a guard that may be easily mounted onto chain saws already in use as the guard of this invention requires only one hole for mounting it to a chain saw handle bracket or the like.

Still a further object is to provide a guard that can be quickly attached or removed from a chain saw by an operator.

Other objects and advantages of this invention will be apparent from a reading of the following specification and claims taken with the drawing.

DETAILED DESCRIPTION OF PREFERRED EMBODIMENTS

Figure 1:
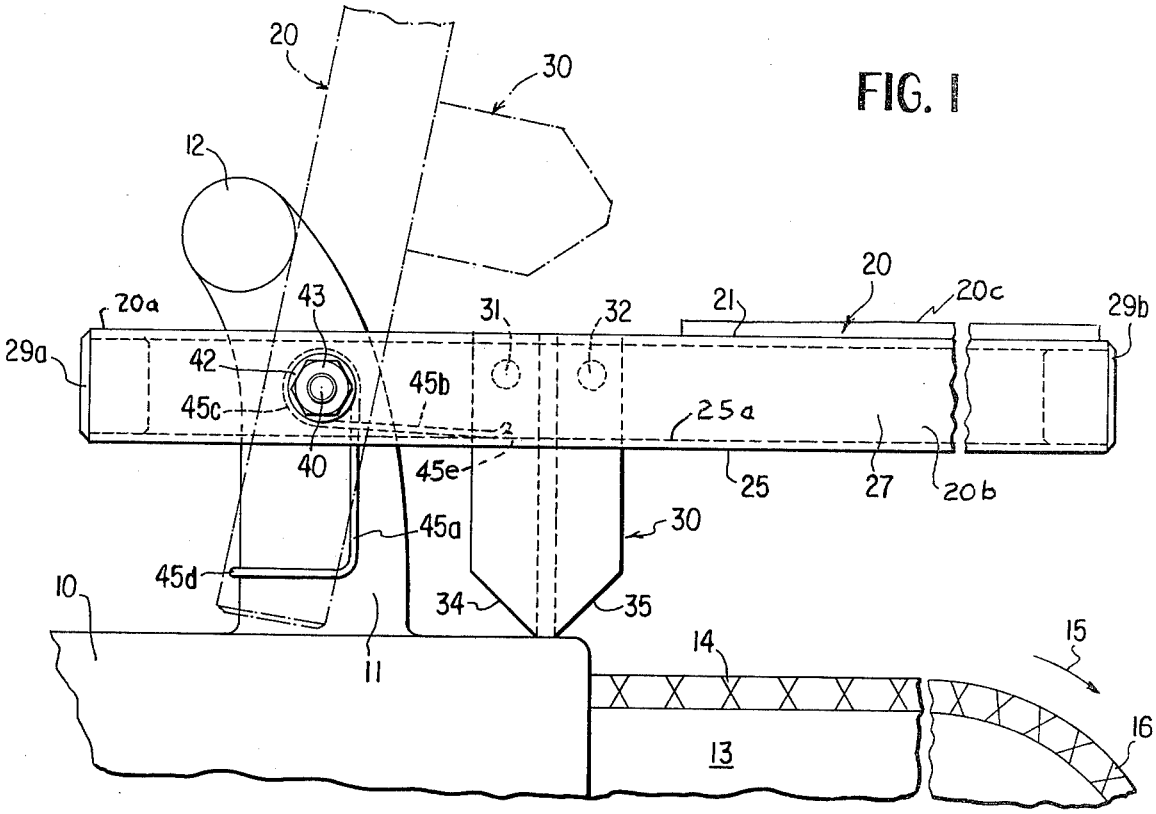
FIG. 1 is a side elevation view of the bar of FIG. 2 diagrammatically illustrating it in combination with a chain saw.

Reference should be made to the drawing where like reference numerals refer to like parts.

Figure 2:
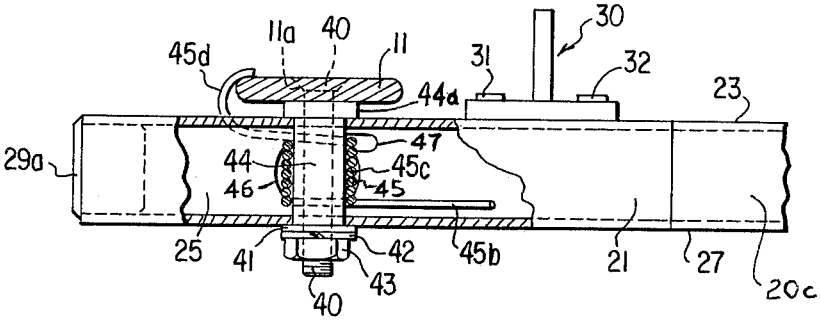
FIG. 2 is a plan view of an illustrative safety bar in accordance with the invention.

FIGS. 1 and 2 diagrammatically indicate components of a conventional chain saw such as housing 10 and a handle 12 supported by a bracket 11 mounted on the housing. An endless cutting chain 14 is conventionally mounted with respect to the housing via a blade 13 where the chain moves in the direction of arrow 15.

Figure 3:
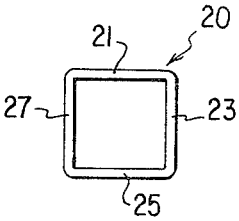
FIGS. 4 and 3 are respective bottom and end views of the safety bar of FIG. 1.

A bar 20 which serves as the safety device in accordance with the present invention may be hollow (FIG. 3) and made of a lightweight metal such as aluminum. Further, it may be sealed by two end plugs 29*a* and 29*b*. The sides 21, 23, 25, 27 of bar 20 may be wider than the width of chain 14 but not so wide as to obstruct vision during use. Typically, the bar includes a forward section 20*b* which extends from a point approximately adjacent the end 16 of chain 14 and an integral rear section 20*a* which extends to a point rearward of the handle mounting bracket 11. The bar may be provided with a padding 20*c* disposed on forward section 20*b*.

Figure 4:
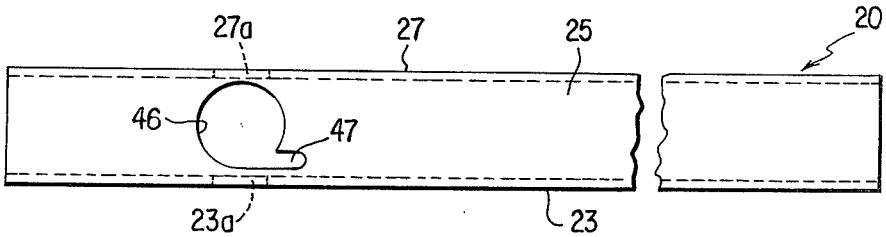

The bar is pivotally mounted with respect to handle mounting bracket 11 via a tubular standoff 44. A flat head screw 40 extends through the standoff and secures the bar to bracket 11 together with a flat washer 41, a lock washer 42 and nut 43. Standoff 44 is provided with a flange 44*a* at one end thereof. Typically, the inner diameter thereof may be about 0.002" greater than the diameter of flat head screw 40. Thus, the standoff acts as a bearing sleeve around which bar 20 (which has holes 23*a* and 27*a* (see FIG. 4) provided in sides 23 and 27 thereof) can pivot between a lowered position substantially parallel to chain 14 shown in solid lines and a raised position indicated in phantom lines.

When the bar is in its lowered position, it is preferably spaced three to four inches above and directly over cutting chain 14 so that it is in substantially the same plane as the chain. In general, it may be spaced two to four inches above the cutting chain. To maintain this spacing, a T-shaped bar stop bracket 30 is secured to the bar 20 on the side 23 by rivets 31 and 32 where bracket 30 extends from the bar to housing 10 when the bar is in its lowered position. Bracket 30 is preferably constructed of a durable lightweight material and may be trimmed at the lower corners 34, 35 to reduce weight.

In order to lightly bias bar 20 toward its lowered position, a spring 45 has a coiled section 45*c* disposed around standoff 44, a first leg 45*b* connected to one end of section 45*c* which extends forwardly inside the bar and rests on the interior surface 25*a* of wall 25 (FIG. 1) where the end 45*e* of leg 45*b* may be bent upward to lessen friction with surface 25*a* and a second leg 45*a* connected to the other end of section 45*c* which extends downwardly out a leg 47 of a hole 46 in the wall 25 (FIG. 4) and is bent around handle mounting bracket 11 at 45*d*. The length of leg 47 is such as to allow some play for leg 45*a* as the bar is moved between its lowered and raised positions.

Hole 46 and leg 47 facilitate assembly in that coiled portion 45*c* of the spring and leg 45*b* are inserted into bar 20 perpendicularly through hole 46 where the diameter of the hole is slightly larger than the diameter of the coiled portion 45*c*. The hole is directly below the position the spring assumes when the bar is in use. Once the spring has entered the bar, it is rotated into alignment with holes 23*a* and 27*a*. Standoff 44 may then be inserted through these holes and the coiled portion 45*c*. Since the diameter of flange 44*a* of standoff 44 is greater than the diameter of hole 23*a*, the standoff and spring 45 will now be positioned with respect to one another as shown in FIG. 2. At this point, the flat head screw 40 may be inserted through a hole 11*a* formed in handle bracket 11 and thence through standoff 44 and hole 27*a*. After washers 41 and 42 are mounted, nut 43 is threaded onto screw 40 to rotatably secure safety bar 20 to handle bracket 11. By reversing the foregoing process, the bar may be disassembled for storage.

In operation such as when the chain saw is used to cut down through a log, bar 20 pivots upwardly against the bias of spring 45 when it contacts the log and remains in contact therewith until the saw cuts through the log. Due to the streamlined shape of the bar and its light weight, the bar does not obstruct visability or hamper the foregoing operation. Should the operator wish to cut from underneath the log, he may depress the rear section 20*a* of the bar against the bias of spring 45 to the dotted line vertical position indicated in FIG. 1 whereby the blade can be inserted under the log to effect the desired undercut. At this time the bar will be resting on the top of the log due to the bias of the spring. The spring also exerts a hold back bias on the bar if, for example, the saw is raised to a vertical position to cut off a limb; yet, as indicated above, the bias is light enough to allow an operator to pivot the bar out of the way to facilitate undercutting. Instead of integral rear section 20*a*, a lever (not shown) may be attached to bar 20 to effect pivoting of the bar away from its lowered position where the lever may extend upwardly and rearwardly from the bar. Regardless of the means employed to pivot the bar from its lowered position, it can be seen that the bar is positioned between the operator and the cutting chain to act as a safety device in protecting the operator from kickback, accidental dropping of the saw, etc.

It is to be understood that the above detailed description of the various embodiments of the invention is provided by way of example only. Various details of design and construction may be modified without departing from the true spirit and scope of the invention as set forth in the appended claims.

What is claimed:

1. In combination with a chain saw having a housing and an endless cutting chain supported by the housing, an elongated, tubular bar, means for pivotally mounting said bar with respect to said housing so that, in a lowered position thereof, the bar extends in the plane of the cutting chain substantially parallel to and above the chain, means disposed within the tubular bar for biasing said bar toward the lowered position, a stop member for maintaining a predetermined spacing between the bar in its lowered position and the cutting chain where said spacing is open to facilitate viewing of the cutting chain in operation and means for pivoting the bar from its lowered position to a raised position to facilitate undercut operations.

2. The combination of claim 1 where the bar includes a rear section extending rearward of the bar pivot point, the rear section being integrally connected to a forward section of the bar which extends forward of the bar pivot point parallel to the cutting chain, said rear section comprising said means for pivoting the bar from its lowered position.

3. The combination as in claims 1 or 2 where the predetermined spacing between the bar in its lowered position and the cutting chain is 2–4 inches.

4. The combination as in claim 3 where said predetermined spacing is 3–4 inches.

5. The combination as in claim 1 where at least a portion of the bar is padded.

6. The combination as in claim 1 where said chain saw includes a handle and a member for mounting the handle and where the combination includes a shaft mounted by the handle mounting member, said bar being pivotally mounted about the shaft and said biasing means including a spring having a coiled section disposed around the shaft.

7. The combination as in claim 6 where said spring includes (a) a first leg connected to one end of the coiled section where the other end of the first leg is attached to the handle mounting member and (b) a second leg connected to the other end of the coiled section where the other end of the second leg is biased against the inside of the tubular bar to bias the bar to its lowered position.

8. The combination as in claim 7 where said bar includes a hole to facilitate insertion of the spring in the bar during assembly of the combination.

9. The combination as in claim 8 including a slot extending from said hole through which said first leg of the spring extends.

* * * * *